US005850943A

United States Patent [19]

Tichenor et al.

[11] Patent Number: 5,850,943

[45] Date of Patent: Dec. 22, 1998

[54] UTILITY-POWER OPERATED TAMPER-PROOF PRESSURIZED SPRAY CAN

[76] Inventors: Clyde L. Tichenor, 905 N. Oak St., Fillmore, Calif. 93015; Irwin Ginsburgh, 24125 Clearbank La., Newhall, Calif. 91321

[21] Appl. No.: 844,892

[22] Filed: Apr. 22, 1997

[51] Int. Cl.[6] ..... B65B 5/00

[52] U.S. Cl. ..... 222/153.11; 222/153.14; 222/504; 251/89; 251/129.01

[58] Field of Search ..... 222/153.11, 153.14, 222/402.1, 402.11, 402.13, 504, 402.15; 251/65, 89, 129.01

[56] References Cited

U.S. PATENT DOCUMENTS

| | | | |
|---|---|---|---|
| 5,385,271 | 1/1995 | Bierend et al. | 222/153.14 |
| 5,427,277 | 6/1995 | Bierend et al. | 222/504 X |
| 5,603,433 | 2/1997 | Rene | 222/504 X |
| 5,791,520 | 8/1998 | Tichenor | 222/504 X |

*Primary Examiner*—Kevin P. Shaver
*Attorney, Agent, or Firm*—Albert O. Cota

[57] ABSTRACT

A utility-power operated tamper-proof pressurized spray can (10) which can only be operated when connected to a utility a-c Power source. Thus, its use to spray graffiti is prevented or at least minimized. The spray can (10) is presented in two design configurations. In the first design, a solenoid/valve assembly is mounted on the top cover of a spray can and on the second design the solenoid/valve assembly is located on the can's lower cover. The first design utilizes a housing (12) that encloses the solenoid/valve assembly which consists of an upper fixed armature (20), a moving armature (36) and a lower fixed armature (58). Between the upper fixed armature (20) and the moving armature (36) is inserted a compliant leaf (48) that functions as a valve. Around the housing (12) is removably attached an electric coil (86) that when connected to a utility a-c power source produces a magnetic field that is applied to the solenoid/valve assembly. The magnetic field causes the moving armature (36) to be displaced which separates the complaint leaf (48) which then allows paint to flow upwards and be sprayed. The arrangement of the upper fixed armature (20) and the moving armature (36) precludes the use of a permanent magnet to cause the moving armature (36) to move downward into the paint spraying positions

7 Claims, 2 Drawing Sheets

UTILITY-POWER OPERATED TAMPER-PROOF PRESSURIZED SPRAY CAN

This application claims benefit of U.S.C. Provisional Appln. 60/015,959, filed Apr. 22, 1996.

TECHNICAL FIELD

The invention pertains to the general field of pressurized spray cans and more particularly to a spray can that can only be activated when attached to an electrical coil that must be connected to a utility a-c power source. The design of invention precludes the use of a permanent magnet to activate the spray can.

BACKGROUND ART

Currently government agencies are turning towards legislation requiring the sale. and use of spray paint cans that incorporate technologies to prevent graffiti such as propose herein. Obviously such legislation offers a preventative solution not previously utilized. It is necessary because graffiti is. an uncontrolled epidemic where it exists. Even the spray paint industry estimates the graffiti clean-up and removal costs taxpayers an estimated $7 billion a year nationwide. Further breakdown of such figures will show that the use of spray paint costs the taxpayer $10 for each can of spray paint used. vandals armed with aerosol spray paint account for the vast majority of graffiti in most communities. At least $4 billion of the damage nationwide is attributed to aerosol spray paint.

Graffiti decreases property values, cripples business and demoralizes our neighborhoods. graffiti also brings other criminal and gang related activities into these affected areas and often precipitates the commission of violent crime. It also imposes a burden upon law enforcement and our criminal justice system and reduces resources available to address other crime problems.

The pressurized spray cans disclosed requires only minor modifications to the manufacturing process and the portability of the spray paint can be eliminated. This non-portability makes such spray cans useless to taggers in public areas, while still permitting their use in or near the home, garage or business. The required minor modifications in the manufacturing process would be passed on to consumers in the form of a small price increase.

The spray can modifications also benefit the paint industry since such modified cans can be sold in normal open counter locations. Alternatively most sales now require going to a locked cabinet for customer access and some legislatures are passing or have pending bills that totally ban sale of spray paint in such cans. These last two solutions are drastic and hurt both retail sales and the wholesaler as well as the manufacturer.

DISCLOSURE OF THE INVENTION

The tamper-proof pressurized spray can disclosed herein is presented in two designs both of which utilize a solenoid valve assembly that can only be operated if the can is connected a utility a-c power source. Thus, the spray can cannot be used by a graffiti vandal in remote areas where there is no utility a-c power available. The basic difference in the two designs is that in the first design the valve assembly is located over the upper cover of a spray can and in the second design the solenoid/valve assembly is located on the lower cover of the spray can.

The first design of the pressurized spray can in its most basic design configuration consists of a pressurized spray can having a conventional lower cover and a modified upper cover that includes an upper projecting threaded sleeve. The solenoid/valve assembly consists of a non-magnetic tubular housing into which is inserted and attached an upper fixed fixed armature. The fixed armature has an upper cavity that has inserted a standard spray control valve and a standard spray head. Below the upper fixed armature is a moving armature having an upper surface that extends upward into a lower collar section located on the upper fixed armature. Between the two armatures is attached an articulated compliant leaf which functions as a valve, and below the moving armature is located a lower fixed armature. The lower fixed armature has an upward extending cavity with internal threads that are dimensioned to be threaded into threaded upper projecting sleeve. Around the tubular housing is located a removable electric coil that produces a magnetic field, which penetrates the housing and enables the solenoid/valve assembly, when the coil is connected to a utility a-c power source.

When the electric coil is not energized, a spring located between the moving armature and the lower fixed armature maintains the moving armature in the upward direction. In this directions the compliant leaf is pressed against a paint bore in the upper fixed armature which prevents paint flow. conversely, when power is applied to the coil, the magnetic field causes the moving armature to overcome the spring bias and move downward. In this position,'paint will flow upward and can sprayed when the spray head is depressed.

The second design of the pressurized spray can, in its most basic design configuration, consists of a pressurized spray can having a conventional upper cover and a modified lower cover that includes a downward extending cavity having. a lower surface. The valve assembly in the second design is enclosed within a non-magnetic cup-type housing. On the upper end of the housing is attached an upper fixed armature having an upper cavity that is dimensioned to receive the lower end of a siphon tube. The upper end of the siphon tube is inserted into the standard spray control valve. Below the upper fixed armature is located and attached the moving armature, and between the two armatures is attached the articulated compliant leaf. In this second design, the lower fixed armature is attached to the bottom surface of the cup-type housing. Around the housing is located a removable electric coil that also functions to enable the valve assembly as described above.

Both solenoid/valve assemblies are designed to remain disabled when a permanent magnet is placed along the side of the solenoid/valve housing. This disabling feature is accomplished in two ways. In the first and primary way, the upper fixed armature is designed with a lower collar section that slidably surrounds the upper part of the moving armature. This configuration insures that when any external magnetic field is positioned on the housing below the sliding armature, its magnetic field will polarize both the fixed and sliding armature. When this occurs, the two armatures grip each other magnetically and since they are in peripheral contact, no amount of external permanent field can separate the two armatures. In the second way, when the moving armature is forced downward, against the spring pressure, it stops short of the lower fixed armature leaving a gap due to the closure of the spring coils. This gap, also helps to defeat the use of an external permanent magnet to enable the solenoid/valve assembly.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment that is disclosed in two designs. In both designs, the purpose of the invention is to produce a pressurized (aerosol) spray can that can only be used to spray paint if an electrical coil that is energized by an a-c electrical outlet, is placed around the spray can. The design also precludes the use of the aerosol spray can if a permanent magnet is placed adjacent to the can.

Figure 1:
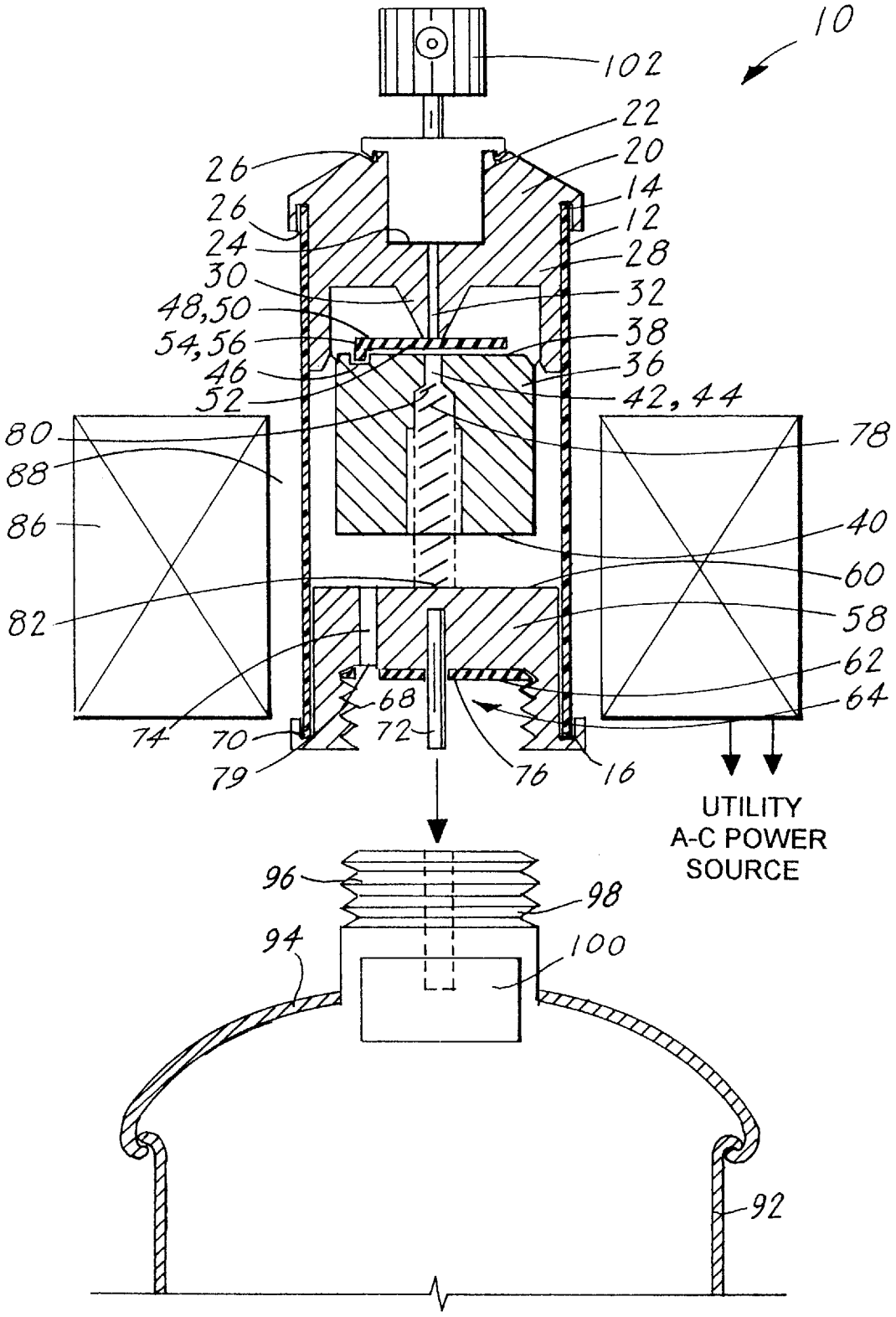
FIG. 1 is a sectional view of the first design of the preferred embodiment. This design includes a threaded sleeve that is attached to a threaded valve located on the upper cover of a pressurized spray can.

The first design of the utility-power operated, tamper-proof pressurized spray can 10, as shown in FIG. 1, is comprised of the following major elements: a non-magnetic tubular housing 12, an upper fixed armature 20, a moving armature 36, a compliant leaf 48, a lower fixed armature 58, a spring 78, and an electric coil 86.

The first design of the spray can 10 utilizes a pressurized spray can 92 having a conventional lower cover and a modified upper cover 94. The upper cover 94 includes an upper projecting sleeve 96, which has external threads 96, and functions to enclose a crimped, standard spray control valve 100.

Providing an enclosure for the elements of the spray can 10, is the non-magnetic tubular housing 12, which has an upper end 14 and a lower end 16. Into the upper end 14 of the housing 12 is inserted the upper fixed armature 20. The armature 20 has an upper cavity 22 that includes a lower surface 24, a crimp slot 26 that interfaces with the upper end 14 of the housing 12, a lower collar section 28 and a downward extending valve cone 30. The valve cone 30 has a paint bore 32 that extends upward and pierces the lower surface 24 of the upper cavity 22. Inserted into the upper cavity 22 on the armature 20, and held therein by a crimping means, are the standard spray control valve 100 and a standard spray head 102.

Located below the upper fixed armature 20, is the moving armature 36. The moving armature 36 has an upper surface 38 that extends into the lower collar section 28 of the fixed armature 20, a lower surface 40 and a stepped spring retaining bore 42.

Between the upper fixed armature 20 and the moving armature 36 is the compliant leaf 48. The leaf 48 includes an upper surface 50, a lower surface 52, and an articulated end 54 that is attached by an attachment means, to the side of the upper surface 38 of the moving armature 36. The attachment means is preferably comprised of the articulated end 54 of the compliant leaf 48 additionally having a downward extending tab 56 that is moveably crimped into the crimp slot 46 located on the side of the upper surface 38 of the moving armature 36. The upper surface 50 of the leaf interfaces with the paint bore 32 on the valve cone 30 of the fixed armature 20 and the lower surface 52 interfaces with the spring retaining bore 42 on the moving armature 36.

Located below the moving armature 36 is the lower fixed armature 58 which includes an upper surface 60 and a lower surface 62. The lower surface 62 has a cavity 64 with internal threads 68 that are dimensioned to be threaded into the external threads 98 on the upper cover 94 of the aerosol spray can 92 as shown in FIG. 1. The lower surface 62 includes an outer edge 63 which has a crimp slot 70 that allows the lower fixed armature 58 to be crimped to the lower end 16 of the tubular housing 12. From the center of the cavity 64 extends downward a valve enabling pin 72. The fixed armature 58 further has a non-central paint bore 74, which allows paint to flow upward when the fixed armature 58 is attached to the upward projecting sleeve on the aerosol spray can 92.

The spring 78, which is located within the spring retaining bore 42 in the moving armature 36, consists of an upper end so and a lower end 82. The upper end 80 is inserted into the spring retaining bore 42 while the lower end 82 rests on the upper surface 60 of the lower fixed armature 58. The spring 78 maintains the moving armature 36 in an upward position when the electric coil 86 is disabled,. thus preventing paint flow.

Encircling the spray can 10 is the electric coil 86, which is designed to produce a magnetic field when connected to a utility a-c power source. The electric coil 86 has means for being externally attached over the tubular housing 12 at a position that optimally induces the magnetic field. The magnetic field is applied only to the moving armature 36 and the lower fixed armature 58. The induced field causes the moving armature 36 to overcome the upward bias of the spring 78 and allows the moving armature 36 to move downward. This downward movement causes the compliant leaf 48 to separate from the paint bore 32 on the upper fixed armature 20. Once the complaint leaf 48 is separated, the pressurized paint will flow upwards into the standard spray control valve 100. Subsequently, when the standard spray head 102 is depressed, the paint can then be sprayed. Further, if an external permanent magnet is placed adjacent to the tubular housing 12, the magnet will produce magnetic fields, which cause the upper fixed armature 20 and the moving armature 36 to lock together, thus preventing any paint flow.

Additionally, the spray can 10 further comprises a resilient gasket 76 that assures a tight seal when the two threaded sections 96 and 68 are attached. This gasket has a central pin opening 77 that fits over the valve enabling pin 72 on the lower fixed armature 58 and a non-central opening 79 that fits over the non-central paint bore 74 on the lower fixed armature 68.

Figure 2:
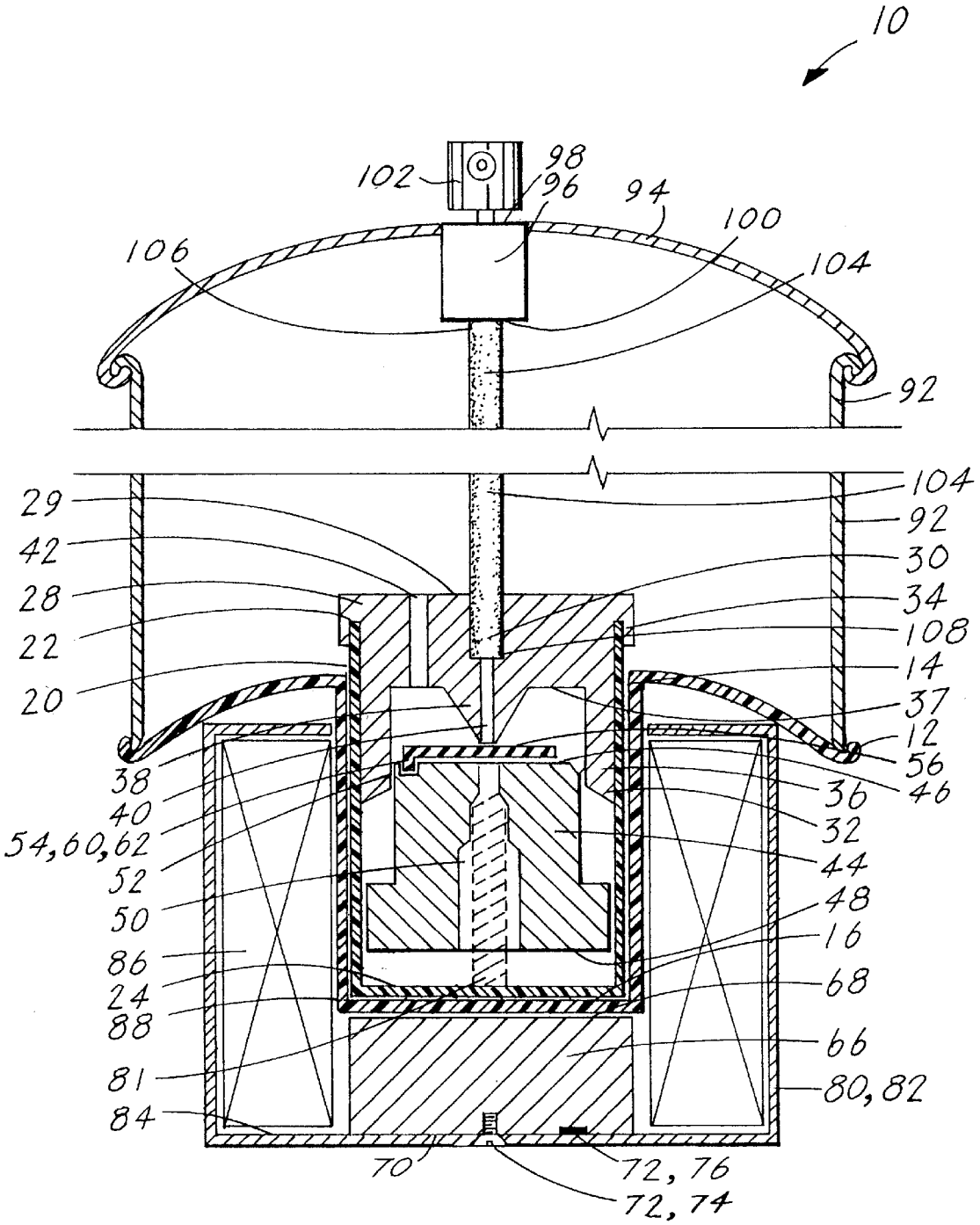
FIG. 2 is a sectional view of the second design of the preferred embodiment. This design is inserted into a cavity located in the lower cover of a pressurized spray can.

The second design of the utility-power operated tamper-proof pressurized spray can 10, as shown in FIG. 2, is comprised of the following major elements: a lower cover 12, a cup type housing 20, an upper fixed armature 28, a moving armature 44, a compliant leaf 54, a lower fixed armature 66, a spring 78, an electric coil assembly 80 and a siphon tube 104.

The second design of the spray can 10 utilizes a pressurized spray can 92 having a conventional upper cover 94 and a modified lower section 12. The upper cover 94 includes a crimped standard spray control valve 96, which has an upper port 98 and a lower port 100. A standard spray head 102 is inserted into the upper Port 98. The modified lower section 12 is comprised of a non-magnetic material having, substantially centered, a downward extending cavity 14 with a lower surface 16.

Extending downward from the crimped standard spray control valve 96 is the siphon tube 104. The siphon tube 104 has a lower end 108 and an upper end 106. The upper end 106 is inserted into the lower port 100 on the control valve 96.

In order to provide a location for the elements of the spray can 10, the elements are placed within .the non-magnetic, cup-type housing 20. The housing 20 has an open upper end 22 and a lower surface 24, which interfaces with the lower surface 16 of the downward extending cavity 14.

Located within the housing 20 is the upper fixed armature 28. The upper fixed armature 28 includes an upper surface 29, an upper cavity 30 that includes a lower surface 32, which is dimensioned to receive the lower end 108 of the siphon tube 104. The fixed armature 28 further has a crimp slot 34, a lower collar section 36 and a downward extending valve cone 38 that includes a paint bore 40, which extends upward and pierces the lower surface 32 of the upper cavity 30. The upper fixed armature 28 also has a paint entry bore 42 that extends from the upper surface 29 to the collar surface 39. The upper fixed armature 28 is inserted into the open upper end 22 of the housing 20 with the crimp slot 34 interfacing with the edges of the open upper end 22 of the housing 20.

Located below the upper fixed armature 28 is the moving armature 44. The moving armature 44 has a lower surface 48, a stepped spring retaining bore 50, a crimp slot 52, and an upper surface 46 that extends into the lower collar section 36 of the fixed armature 28.

Interfacing with the moving armature 44 is the compliant leaf 54. The compliant leaf 54 has an upper surface 56, a lower surface 58, and an articulated end 60 that is attached by an attachment means, to the side of the upper surface 46 of the moving armature 44. The attachment means comprises a downward extending tab 62 that is crimped into the crimp slot 52 located on the side of the moving armature 44. The upper surface 56 interfaces with the paint bore 40 on the valve cone 38 of the upper fixed armature 28. The lower surface 58 interfaces with the spring retaining bore 50 on the moving armature 44.

Located below the cup-type housing 20 is the lower fixed armature 66, which has an upper surface 68 and a lower surface 70.

Located within the spring retaining bore 50 is the spring 78. The spring 78 has an upper end 79 and a lower end 81. The upper end 79 is inserted into the spring retaining bore 50 on the moving armature 44 while the lower end 81 rests on the lower surface 24 of the cup-type housing 20. The spring; 78 functions to maintain the moving armature 44 in an upward position, which prevents paint flow.

Encircling the spray can 10 is the electric coil assembly 80. The electric coil assembly 80 is comprised of a circular magnetic housing 82 that has a bottom surface 84 and that encloses a circular electric coil 86 which is designed to be operated by a utility a-c power source. The coil 86 has an inner surface 88 that is dimensioned to fit into and interface with the downward extending cavity 14. On the bottom surface 84 of the circular magnetic housing 82 is attached, by an attachment means such as'a screw 74 or an adhesive 76, the lower fixed armature 66. The upper surface 68 of the armature 66 interfaces with the lower surface 16 of the downward extending cavity 14.

The coil 86 is designed to induce a magnetic field into only the moving armature 44 and the lower fixed armature 66. The induced magnetic field causes the moving armature 44 to overcome the upward bias of the spring 78 and allows the armature 44 to move downward. This downward movement causes the compliant leaf 54 to separate from the paint bore 40 on the upper fixed armature 28. Once the compliant leaf 54 is separated from the paint bore 40 the paint is allowed to flow upward into the standard spray control valve 96. When the standard spray head 102 is depressed, the paint can be sprayed. If an external permanent magnet is placed adjacent to the cup-type housing 20, the magnet produces magnetic fields, which cause the upper fixed armature 28 and moving armature 44 to lock together, thus preventing any paint flow.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

We claim:

1. A utility-power operated tamper-proof pressurized spray can comprising:

a) an aerosol spray can having a lower cover and a modified upper cover wherein the upper cover having an upward projecting sleeve with external threads and that encloses a first crimped spray control valve, b) a non-magnetic tubular housing having an upper end and a lower end, c) an upper fixed armature having an upper cavity that includes a lower surface, a crimp slot, a lower collar section, a downward extending valve cone, with said cone having a paint bore that extends upward and Pierces the lower surface of the upper cavity, wherein said upper fixed armature is inserted into the upper end of said housing with the crimp slot interfacing with the upper end of said housing, d) a second spray control valve and second spray head wherein said second valve is inserted into the upper cavity on said upper fixed armature and held therein by a crimping means, e) a moving armature having an upper surface that slidably extends into the power collar section of said fixed armature, a lower surface and a stepped spring retaining bore, f) a compliant leaf having an upper surface, a lower surface and an articulated end that is attached to the side of the upper surface of said moving armature by an attachment means, wherein the upper surface interfaces with the paint bore on the valve cone of said fixed armature and the lower surface interfaces with the spring retaining bore on said moving armature, g) a lower fixed armature having an upper surface and a lower surface, wherein the lower surface having a cavity with internal threads that are dimensioned to be threaded into the external threads on the upper cover of said aerosol spray can, and wherein the outer edge of the lower surface having a crimp slot that allows said lower fixed armature to be crimped to the lower end of said tubular housing wherein from the center of said cavity extends downward, a valve enabling pin, said armature further having a non-central paint bore that allows paint to flow upward when said lower fixed armature is attached to the aerosol spray can, h) a spring having an upper end and a lower end, wherein the upper end of said spring is inserted into the spring retaining bore on said moving armature with the lower end of said spring resting on the upper surface of said lower fixed armature wherein said spring maintains said moving armature in an upward position which prevents paint flow, i) an electric coil that is designed to be operated when connected to a utility a-c power source having means for being externally attached over said tubular housing at a position'that induces a magnetic field into only said moving armature and said lower fixed armature, wherein the induced magnetic field causes said moving armature to overcome the upward bias of said spring and allow said moving armature to move downward, wherein this downward movement causes said compliant leaf to separate from the paint bore on said, upper fixed armature which then allows the paint to flow upwards into said second spray control valve, whereupon when said second spray head is depressed, paint can be sprayed, and wherein if an external permanent magnet is placed adjacent to said tubular housing, the magnet produces magnetic fields which cause said upper fixed armature and said moving armature to lock together to prevent any paint flow.

2. The spray can as specified in claim 1 wherein said compliant leaf attachment n)means comprises: said articulated end of said compliant leaf further having a downward extending tab that is crimped into a crimp slot located on the side of the upper surface of said a moving armature.

3. The spray can as specified in claim 1 further comprising a resilient gasket having a central pin opening that fit over the valve enabling pin on said lower fixed armature and a non-central opening that fits over the non-central paint bore on said lower fixed armature.

4. A utility-power operated tamper-proof pressure spray can comprising:

a) an aerosol spray can having an upper cover and a modified lower cover, wherein the upper cover includes a crimped spray control valve having an upper port and a lower port, where into said upper port is inserted a standard spray head, and wherein said modified lower cover is comprised of a non-magnetic material having substantially centered a downward extending cavity having a lower surface, b) a siphon tube having an upper end and a lower end, wherein the upper end is inserted into the lower port on said spray control valve, c) a non-magnetic cup-type housing having an open upper end and a lower surface that interfaces with the lower surface of said downward extending cavity, d) an upper fixed armature having an upper surface, an upper cavity that includes a lower surface and that is dimensioned to receive the lower end of said siphon tube, a crimp slot, a lower collar section, a paint entry bore extending from the upper surface of said upper fixed armature to said armature's collar surface, a downward extending valve cone having a paint bore that extends upward and pierces the lower surface of the upper cavity, wherein said upper fixed armature is inserted into the open upper end of said housing with the crimp slot interfacing with the edges of the open upper end of said housing, e) a moving armature having an upper surface that slidably extends into the lower collar section of said fixed armature, a lower surface, a stepped spring retaining bore, and a crimp slot, f) a compliant leaf having an upper surface, a lower surface and an articulated end that is attached to the side of the upper surface of said moving armature by an attachment means, wherein the upper surface interfaces with the paint bore on the valve cone of said fixed armature and the lower surface interfaces with the spring retaining bore on said moving armature, g) a lower fixed armature having an upper surface and a lower surface, h) a spring having an upper end and a lower end, wherein the upper end of said spring is inserted into the spring retaining bore on said moving armature with the lower end of said spring resting on the lower surface of the cup-type housing wherein said spring maintains said moving armature in an upward position which prevents paint flow, i) an electric coil assembly comprised of a circular magnetic housing having a bottom surface and that encloses a circular electric coil that is designed to be operated by a utility a-c power source, wherein an inner surface of said coil is dimensioned to fit into and interface with said downward extending cavity, and where on the bottom surface of said housing is attached, by an attachment means, the lower fixed armature with the upper surface of said armature interfacing with the lower surface of said downward extending cavity, wherein said coil induces a magnetic field into only said moving armature and said lower fixed armature, wherein the induced magnetic field causes said moving armature to Overcome the upward bias of said spring and allow said moving armature to move downward, wherein this downward movement causes said compliant leaf to separate from the paint bore on the valve cone of said upper fixed armature which then allows the paint to flow upwards into said spray control valve, whereupon when said spray head is depressed, paint can be sprayed, and wherein if an external permanent magnet is placed adjacent to said cup-type housing the magnet produces magnetic fields which cause said upper fixed armature and said moving armature to lock together to prevent any paint flow.

5. The spray can as specified in claim 4 wherein said compliant leaf attachment means comprises said articulated end of said compliant leaf further having a downward extending tab that is crimped into a crimp slot located on the upper surface of said moving armature.

6. The spray can a specified in claim 4 wherein said fixed armature attachment means comprises a screw.

7. The spray can as specified in claim 4 wherein said fixed armature attachment means comprises an adhesive.

* * * * *